US005942857A

United States Patent [19]

Hsu

[11] Patent Number: 5,942,857

[45] Date of Patent: Aug. 24, 1999

[54] BULB-SHAPED LIGHT STRING FLASHER

[76] Inventor: Fu-Hsien Hsu, No. 35, Kuan Chen Road, Swang Si Tsuan, Po San Hsain, Hsinchu Hsien, Taiwan

[21] Appl. No.: 09/124,260

[22] Filed: Jul. 29, 1998

[51] Int. Cl.[6] ..... H05B 37/02

[52] U.S. Cl. ..... 315/185 S; 315/200 A

[58] Field of Search ..... 315/225, 185 S, 315/193, 189, 186, 185 R, 200 A; 362/124, 249, 251, 806; 307/11, 132 R

[56] References Cited

U.S. PATENT DOCUMENTS 3,723,723 3/1973 Lerner ..... 362/124

*Primary Examiner*—Michael B. Shingleton

*Attorney, Agent, or Firm*—Rosenberg, Klein & Bilker

[57] ABSTRACT

This invention relates to an improved flashing light string which includes a connecting electrical wire provided with a plurality of bulb holders to connect with housings with bulbs therein and a bulb-shaped shell is provided with an inner small controller which has a pair of conducting wires to be a controlling apparatus, which can be connected with a housing to be received in any bulb holder of the light string to control the light string having different flashing effects.

1 Claim, 4 Drawing Sheets

BULB-SHAPED LIGHT STRING FLASHER

BACKGROUND OF THE INVENTION

A prior art light string is provided with a controller (1) connecting with an electrical wire (3) of the string in order to obtain a flashing effect, as shown in FIG. 1. By use of a circuit in the controller (1), it controls the bulb (2) on the string lighting at different time cyclically. In this design, the controller (1) is connected at an end of the wire (2). The flashing effect is regular without enough variability and it has only a few simply flashing cycles. Moreover, the affixed controller (1) on the light string is not symmetrical and it increases cost and time in manufacture and assembly.

OBJECT OF THE INVENTION

The main object of the present invention is to provide an improved flashing light string, which includes a small controller being received in a bulb-shaped shell to be connected within a housing and to be received in a bulb holder of the light string. The shell with the inner small controller and the housing is capable of being connected with a desired bulb holder to obtain a different flashing effect.

The detailed structure, features, and other advantages of this invention will become apparent from the following detailed description of a preferred embodiment when read with reference to the accompanying drawings.

DETAILED DESCRIPTION OF THE EMBODIMENT

Figure 1:
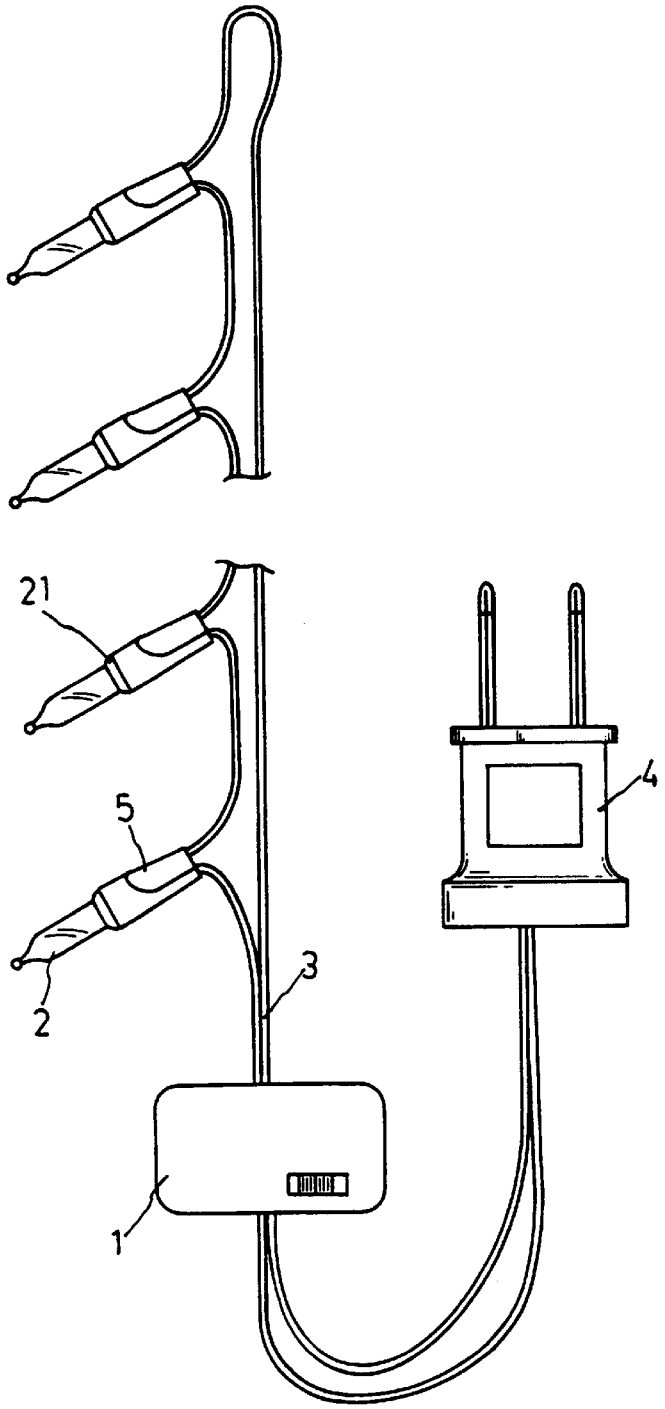
FIG. 1 (prior art)
FIG. 1 is a perspective view of a flashing light string of a prior art structure.
Figure 2:
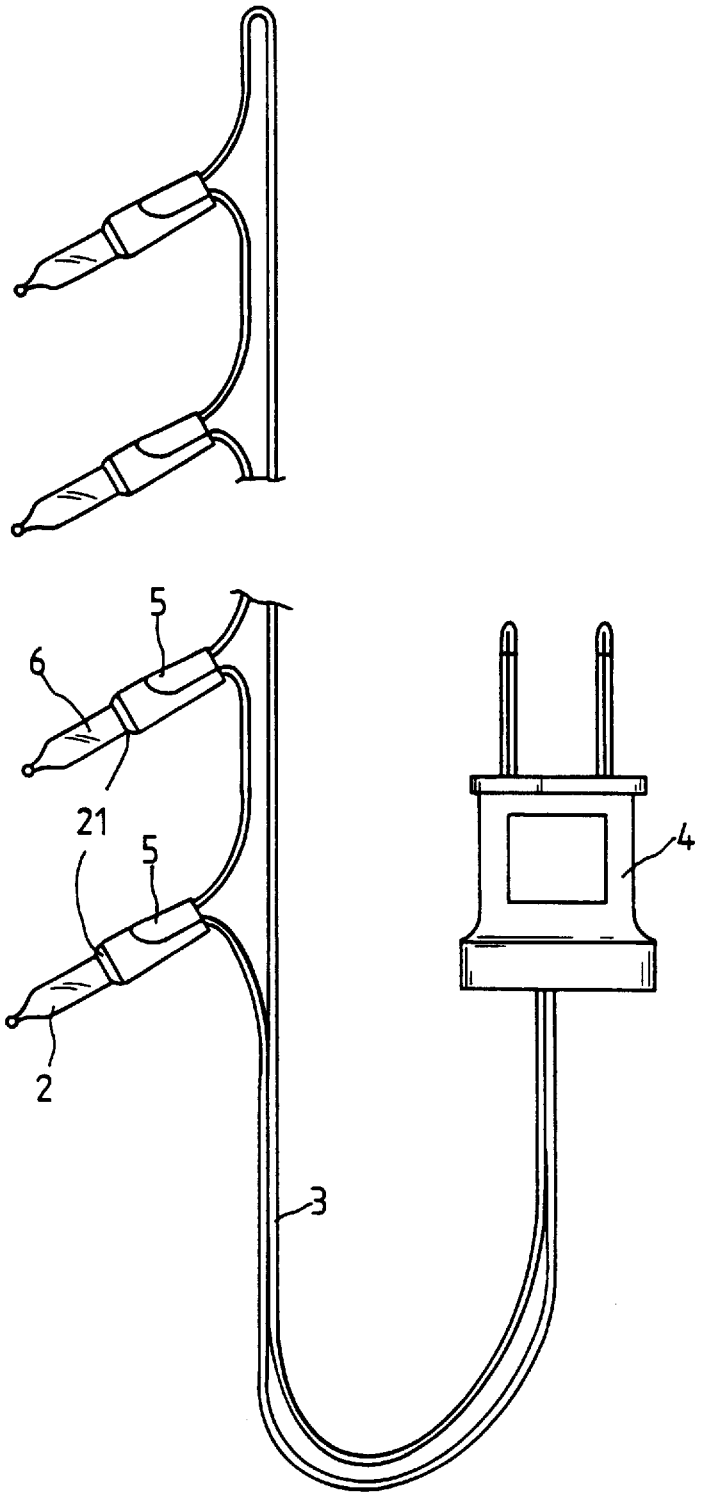
FIG. 2 is a perspective view of a flashing light string according to the present invention.
Figure 3:
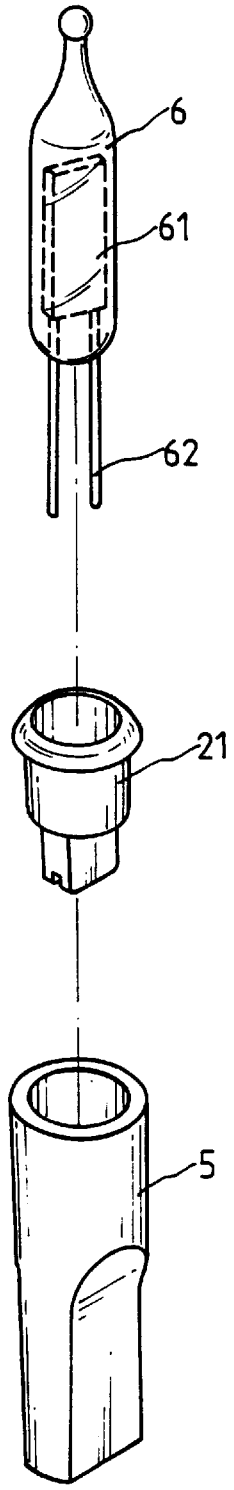
FIG. 3 is an exploded perspective view of a controlling apparatus according to this invention.
Figure 4:
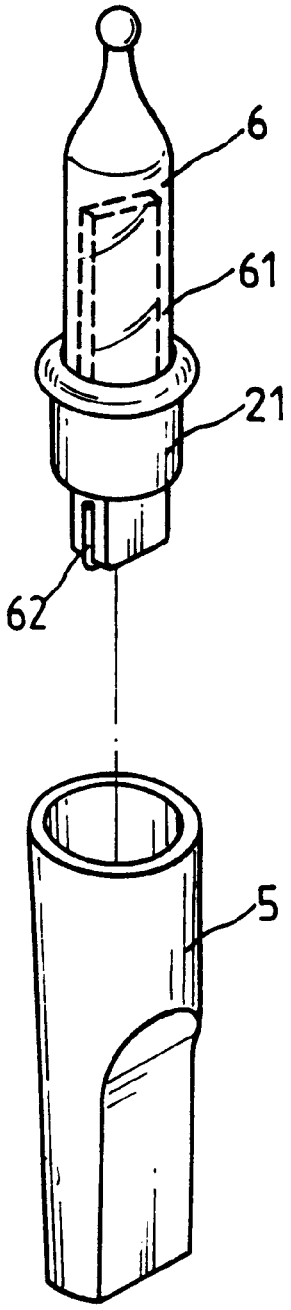
FIG. 4 is a perspective view of FIG. 3 showing a shell being connected with a housing.

Please refer to FIGS. 2 to 4, the present invention is to provide an improved flashing light string, which includes a connecting wire (3) having a plug (4) to connect with an electrical supply. A plurality of bulb holders (5) are provided on the wire (3) and each of the bulb holders (5) can receive a related housing (21) connecting with a related bulb (2). It is the characteristic that a small controller (61) is received in a bulb-shaped shell (6) and is provided with a pair of conducting wires (62) to form a controlling apparatus. As shown in FIG. 4, the controlling apparatus can be connected with any bulb holder (5) on the wire (3) to complete a flashing light string according to this invention.

Under the said description, the present invention uses the small controller (61) in the shell (6) to obtain a certain flashing effect. The outlook of the light string of the present invention is formal that the prior affixed controller is unnecessary. It is an advantage that the controller apparatus can be connected with any bulb holder (5) of the light string, each position can obtain a different flashing effect. It can be understood that the flashing effect of this invention is better than of any prior art light string. And the controlling apparatus can be changed to be connected with a different bulb holder very easily.

Accordingly, it can be found that the present invention obtains an obvious improvement for overcoming the known drawback. Thus, the present invention should be approved and allowed for patent.

I claim:

1. A flasher for a light string having a plurality of sockets and a plurality of first bulb holding housings respectively supporting a plurality of light bulbs therein, the first bulb holding housings being respectively received in said sockets, the flasher comprising:

a light bulb-shaped envelope devoid of a light producing filament;

a second bulb holding housing for supporting said envelope;

a small controller disposed within said envelope; and, a pair of leads respectively connected on one end thereof to said controller and extending therefrom through said envelope and into said second bulb holding housing for connection with any one of the plurality of sockets to flash at least a portion of said plurality of light bulbs.

* * * * *